US005249832A

United States Patent [19]

Leonardz

[11] Patent Number: 5,249,832

[45] Date of Patent: Oct. 5, 1993

[54] MAGNETIZED OPENER/CLOSER FOR ZIPPERS

[76] Inventor: Georgia B. Leonardz, 107 Armstrong Dr., Jacksonville, N.C. 28540

[21] Appl. No.: 891,809

[22] Filed: Jun. 1, 1992

Related U.S. Application Data

[63] Continuation-in-part of Ser. No. 772,550, Oct. 7, 1991, abandoned.

[51] Int. Cl.[5] ..... A44B 19/00

[52] U.S. Cl. ..... 294/3.6; 294/65.5; 223/111

[58] Field of Search ..... 294/1.1, 3.6, 65.5, 294/19.1, 24, 26; 24/415, 429; 223/111

[56] References Cited

U.S. PATENT DOCUMENTS

| | | | |
|---|---|---|---|
| 1,347,382 | 7/1920 | Karro | 294/65.5 |
| 2,390,339 | 12/1945 | Ullman et al. | 294/65.5 |
| 2,845,297 | 7/1958 | Doop | 294/3.6 |
| 2,900,205 | 8/1959 | Cirone | 294/3.6 |
| 2,928,157 | 3/1960 | Deering | 294/3.6 |
| 3,310,853 | 3/1967 | Winn | 294/3.6 |
| 3,348,870 | 10/1967 | Zern | 294/65.5 X |
| 3,354,520 | 11/1967 | Morgen | 294/3.6 |
| 3,503,645 | 3/1970 | Huddy | 294/65.5 |
| 3,582,123 | 6/1971 | Kyser | 294/65.5 X |
| 4,015,296 | 4/1977 | Malick | 294/3.6 X |
| 4,022,506 | 5/1977 | Cloud, Sr. | 294/3.6 |
| 4,802,702 | 2/1989 | Bownds | 294/65.5 |

*Primary Examiner*—David M. Mitchell
*Assistant Examiner*—Dean J. Kramer
*Attorney, Agent, or Firm*—John G. Mills & Associates

[57] ABSTRACT

This invention is a magnetized opener/closure for zipper-type slide closures and includes an elongated handle with a 90° bend or elbow at one end thereof. A magnetized disk with a hook extending outwardly from the center thereof is mounted on the outer end of the elbow to allow the tab of a zipper to be engaged and to prevent the same from becoming disengaged until the zipping or unzipping process has been completed. The elbow is weighted to assist in the manipulation of the opener/closure.

7 Claims, 2 Drawing Sheets

MAGNETIZED OPENER/CLOSER FOR ZIPPERS

This application is a Continuation-in-Part of U.S. application No. 07/772,550 filed Oct. 7, 1991, now abandoned.

FIELD OF INVENTION

This invention relates to closures and more particularly to means for manipulating the zippers on the back of garments.

BACKGROUND OF INVENTION

Since the original invention of zipper type closures, the makers of clothing have used the same instead of buttons, clasps and other fastening means. Due to the design of many garments, particularly women's and girl's dresses, it is desirable to put the closure at the back of the garment rather than the front of the garment.

When doning or removing one of the rear closure garments, as long as another person is there to assist the manipulation of the zipper, everything is fine. When no one is there to assist in doning or removing of the garment, difficulty arises.

In these latter incidences, the garment must be either bunched up so that the person can reach the zipper and manipulate the same or in some incidences it is utterly impossible to don or remove the dress without assistance.

BRIEF DESCRIPTION OF INVENTION

After much research and study into the above mentioned problems, the present invention has been developed to provide a hook-like means for engaging the tab of zippers with a 90° weighted elbow and extended handle for manipulating the same. A magnetized member adjacent said hook-like means is provided to aid in preventing the zipper from becoming disengaged from said hook during the zipping or unzipping process. Also the magnetized member causes the zipper tab to stick out for easier engagement with said invention.

DISCUSSION OF PRIOR ART

The following references represent the closest prior art of which the inventor is aware.

U.S. Pat. No. 3,348,870 to Zern discloses a slide fastener actuating device with modifications shown in FIG. 8 including a permanent magnet. Column 6, lines 30 through 36 state that "The transverse section 72*e* is provided with a liner 79 at the rear of which is disposed a permanent magnet 80. The permanent magnet 80 is adapted to draw the slide fastener tab 19 into the open end slot formed by the two sides of the liners 79 to bring the opening 19*a* in the slide fastener tab 19 into alignment with the pin 78."

The present invention does not include a permanent magnet to draw a slide fastener tab into the open end of a slot. The present invention also does not have any of the very complicated mechanical features that make up the Zern Disclosure.

U.S. Pat. No. 2,928,157 to Deering discloses a closing and opening device for separable slide fasteners which includes a hook on the end of a straight, elongated handle. To prevent the hook from becoming disengaged from the slide fastener tab during manipulation, a conical shield 13 is provided which slides down the shaft 10 to cover the tab as shown in FIG. 2.

There are no moving parts in the disclosure of the present application and the magnetized disk lifts and maintains the tab of the slide fastener or zipper in engagement with the hook means. Also the weighted elbow that is disposed at one end of the elongated handle allows the slide fastener to be pulled away from the body of the person using the device of the present invention thus preventing any underlying clothing from being caught therein. This would be impossible when using the Deering closing and opening device.

U.S. Pat. No. 3,310,853 to Winn discloses a device for operating zipper fasteners and includes a hook-like means 21. There is nothing in this Disclosure to maintain the zipper in contact with the hook to prevent the same from becoming accidentally disengaged. This Patent does address the problem of undergarments becoming caught in the zipper but the accomplishment of this is done in an entirely different way than is accomplished by the present invention. Winn provides adjacent the hook, projecting means arranged and adapted to deflect the path of the slide adjacent portions of an undergarment worn by the user and adjacent overlapping portions of the garment in which the zip fastener is fixed. As mentioned above, applicant accomplishes the same thing by the configuration of the handle which allows the slide fastener to be pulled away from the body of the user and any underlying undergarments.

U.S. Pat. No. 2,900,205 to Cirone discloses a slide fastener handle that does have a small elbow in the end thereof. This elbow is not much larger than the zipper tab it is adapted to engage and the elongated rod 22 is of such a small size that it would be impractical to use this device to pull the garment away from the body and undergarments of the person using the same. Applicant's device on the other hand is sturdy enough to readily accomplish this type of procedure. The means of engaging and holding the slide fastener tab shown in Cirone is entirely different from that shown in the present Disclosure and, therefore, this reference is not considered otherwise pertinent.

U.S. Pat. No. 4,802,702 to Bownds discloses a magnetic lifting tool with a disk shaped magnet on one end thereof and an elbow handle on the other end. The purpose of this tool is entirely different from Applicant's and it does not include a hook means. Also the elbow is on the opposite end to act as a handle where Applicant's elbow is on the hook end to assist in manipulation of the slide fastener.

The Patent to Karro discloses a magnet in the end of an elongated walking cane but such a magnet would certainly not be of adequate strength to engage and hold a slide fastener. There is also no suggestion that the cane of Karro could be used to manipulate a slide fastener and there is no suggestion of a hook adjacent the magnet on the end thereof.

U.S. Pat. No. 3,503,645 to Huddy, as well as U.S. Pat. No. 4,015,296 to Malick, U.S. Pat. No. 3,582,123 to Kyser and U.S. Pat. No. 2,390,339 to Ullman et al all include magnets on the end of handle-like devices but none of these references could possibly operate as a magnetized opener/closure for zippers in the manner of the present invention.

OBJECTS OF INVENTION

In view of the above it is an object of the present invention to provide a magnetized opener/closure for zippers which includes a relatively large diameter, elongated handle with a weighted elbow at one end thereof mounting a magnetized disk with a hook outwardly projecting therefrom to engage and hold a zipper tab during opening and closing manipulation thereof.

Another object of the present invention is to provide a magnetized slide closure means that both hooks and by magnetic attraction holds the tab of said slide fastener.

Another object of the present invention is to provide a slide fastener manipulating means that is formed from readily available stock items.

Another object of the present invention is to provide a highly effective and yet relatively inexpensive slide fastener manipulating means.

Another object of the present invention is to provide a magnetized opener/closure for zippers which allows the user thereof to pull the garment away from undergarments during the zipping and unzipping processes.

Another object of the present invention is to provide a zipper opener/closure means with a weighted end to aid in the manipulation of the same.

Other objects and advantages of the present invention will become apparent and obvious from a study of the following description and the accompanying drawings which are merely illustrative of such invention.

DETAILED DESCRIPTION OF INVENTION

Figure 1:
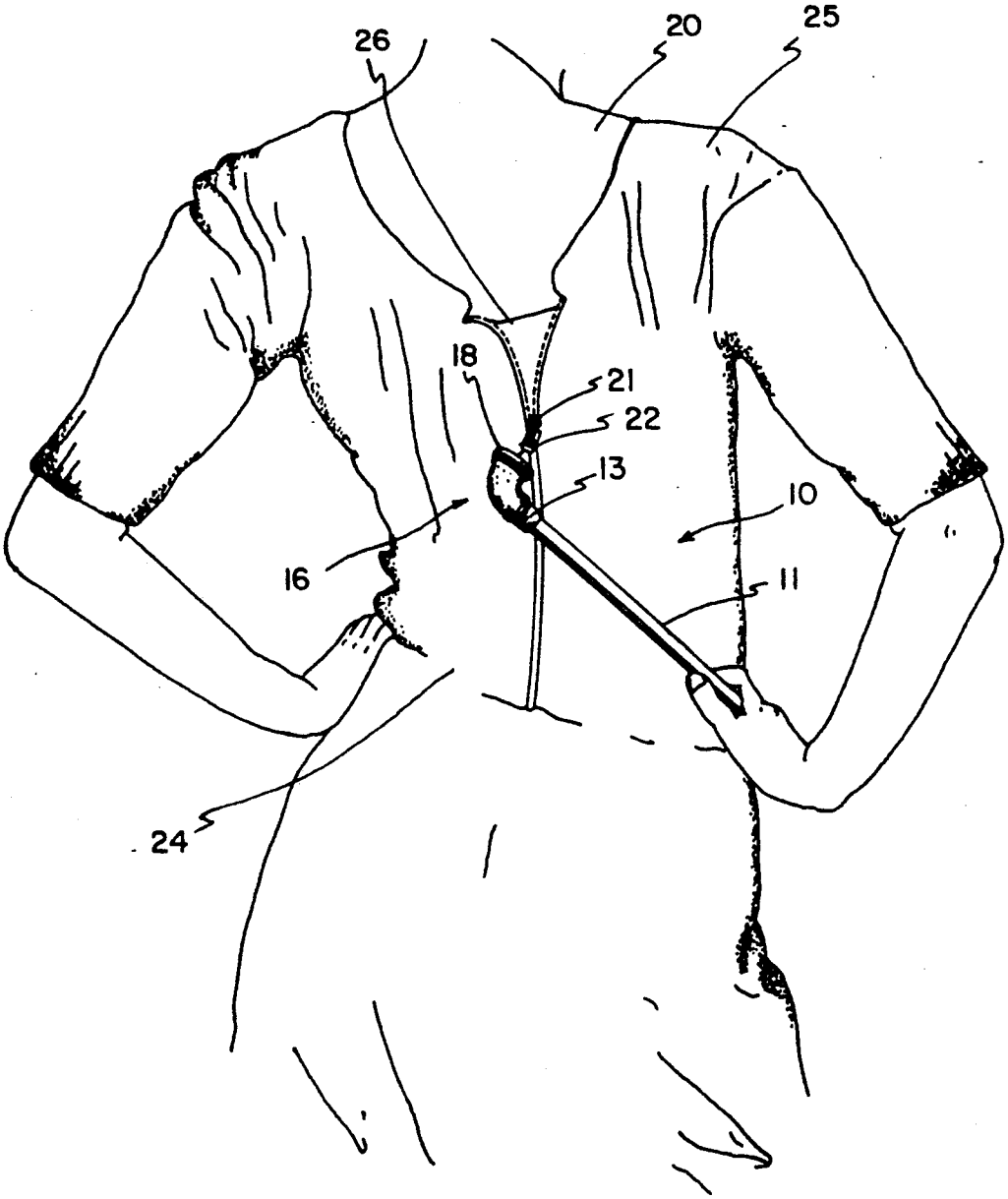
FIG. 1 is a rear perspective view of a person using the magnetized opener/closure means of the present invention.
Figure 2:
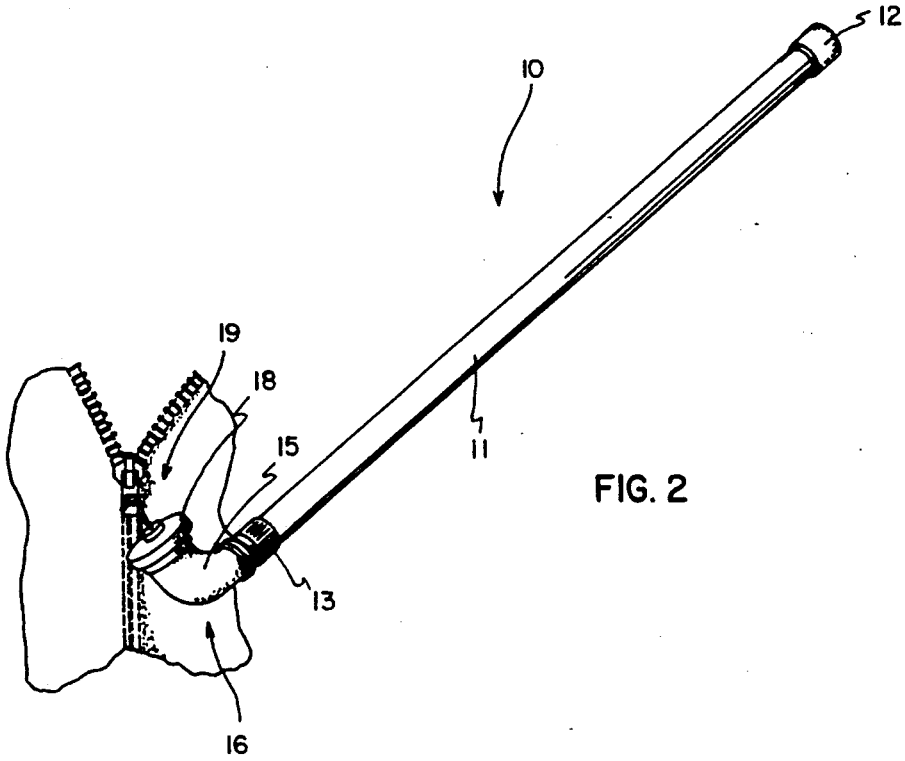
FIG. 2 is an enlarged view of the present invention in use.

With further reference to the drawings, the magnetized opener/closure for zippers, indicated generally at 10, includes an elongated handle means 11 with a cap 12 on one end thereof. One half inch PVC pipe which has an exterior diameter of just over three quarters of an inch has been found to be a good size for gripping while at the same time being light weight and having the required strength. The end cap 12 can be a standard cap for half inch PVC pipe and can be readily glued thereto.

On the end of handle 11 opposite cap 12 is secured an adapter or coupling 13 that is threaded on its outer end as indicated at 14. Coupling 13 can be secured to handle 11 in the same manner as end cap 12.

A 90° elbow shown at 15 is preferably formed from galvanized steel which gives weight to the head portion of the present invention, indicated generally at 16.

A generally disk shaped permanent magnet is mounted on the end of elbow 15 opposite its connection with threaded portion 14 of coupler 13. This magnet 17 can be secured to elbow 15 by any suitable means such as gluing, weldment, threading, or the like.

To give a smooth surface around magnet 17, a housing 18 is provided with rounded edges to cover such magnet. This assures that there are no rough edges that might prick or fray delicate fabrics in connection with which the present invention is being used. This housing can be made of polished metal, plastic or other suitable material so long as it does not interfere with the magnetic field set up by the magnet.

Figure 3:
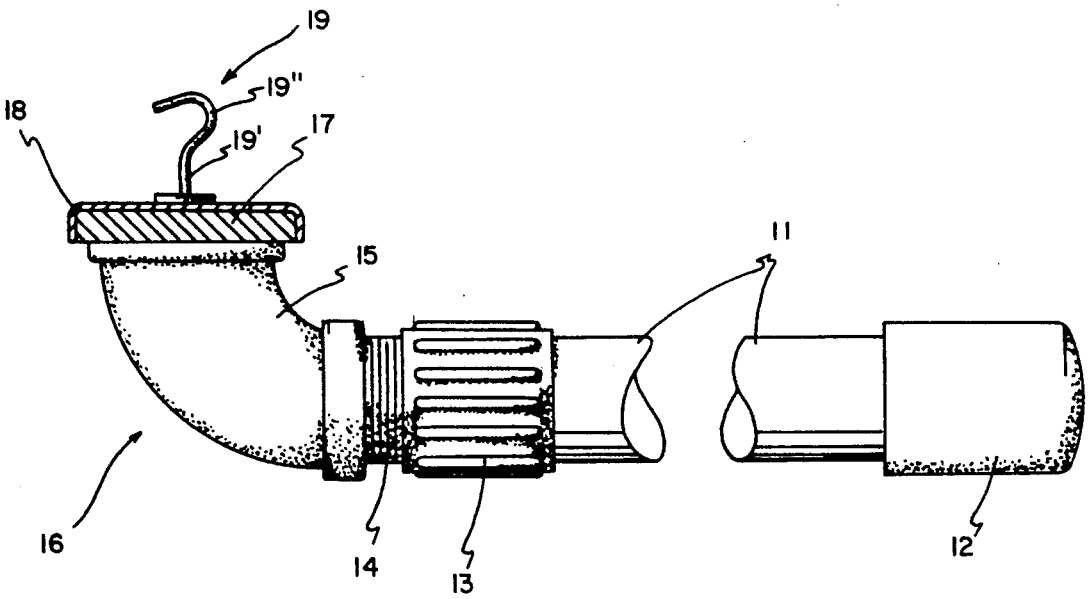
FIG. 3 is a partially cut-away enlarged side elevational view of the present invention.

A hook-like means 19 includes a shaft portion 19' and a hook portion 19'. One end of shaft portion is permanently mounted to the center of the disk shaped magnet housing 18 and outwardly projects therefrom with its opposite end terminating in hook portion 19'' as can clearly be seen in FIG. 3.

When the means of the present invention is to be used by a person 20, such person can grip handle 11 and move the head portion 16 to the area adjacent slide fastener 21. The magnet 17 will make the slide fastener tab 22 stick out due to the magnetic forces exerted thereon. The hook portion 19'' can then be readily inserted into the normal opening 23 in tab 22. With the combined holding power of the hook-like means 19 and the magnetic force being exerted thereon, the tab 22 and its associated slide fastener 21 can be manipulated either up or down the back 24 of garment 25.

A slight outward pressure on handle 11 will pull the slide fastener being manipulated away from the undergarments 26 of the person 20 thus preventing the slide fastener 21 from being jammed by such undergarment. Also on a relatively loose fitting garment 25, the outward pressure will pull the same taunt so that the slide fastener does not get jammed on part of the garment on which it is mounted.

Due to the relative light weight of the elongated handle 11 and the relatively heavy elbow 15 and its associated magnet 17, the means 10 of the present invention can be readily manipulated in to engagement with the slide fastener tab 22 due to the dampening effect of such weight on one end of the handle. Even some one without a steady hand can use the device of the present invention since the combination of the weight having a dampening effect on movement of the device and the magnetic pull exerted by magnet on the tab.

Stated another way, the weighted head portion 16 mounted on the lightweight handle 11 which is of a relatively large diameter, allows the user to get a good grip on such handle to maneuver the head portion to the connection location with the slide fastener. The weighted head also gives good feel and once movement has started in the slide fastener, the weighted head helps maintain the momentum of such movement.

The overall length of the assembled handle 11, cap 12 and coupler 13 is approximately two feet in length. The combined weight of these three assembled parts is approximately three eights of a pound. The head portion 16 including elbow 15, magnet 17, housing 18 and hook 19 also weigh approximately three eights of a pound. Once the head portion has been threadingly mounted on the handle portion, the overall weight of the means 10 of the present invention is approximately three quarters of a pound.

Because the weighted head portion 16 is mounted at one end of the elongated handle 11, the center of gravity of the means 10 is at a point approximately one fourth of the overall length from the head portion 16 and three quarters of the overall length from the end cap 12.

As discussed above, the balance of the means 10 of the present invention allows it to be more easily manipulated and gives a feel of substantialness to the invention. Also the weighted head takes a lot of the effort out of the zipping process.

If the user of the present invention manipulates the same over her shoulder, the weighted head 16 will make the means of the present invention 10 pendulum to vertical which makes connection to the slide fastener easier, particularly when the slide fastener is at the bottom or open position. When the means 10 of the present invention is being manipulated from the back at approximately waist level as shown in FIG. 1 the weighted head tends to move the zipper downwardly due to gravitational forces which aids in the manipulation of such invention.

In use, if the garment is open and it is wished to close the same, an over the shoulder maneuver such as shown in FIG. 1 of the Deering, Winn and Cirone Patents can be used. Due to the weighted head tending to move in a vertical position, attaching the hook means 19 to the zipper slide 21 can be readily accomplished.

When it is desired to open the zipper to remove the clothing associated therewith, the behind the back from waist level maneuver as shown in FIG. 1 can be used. Once the hook means 19 has been placed in operative connection with the slide fastener tab 22, due to the weight of the head portion 16 very little effort is required to unzip the slide fastener 21.

From the above it can be seen that the magnetized slide fastener manipulating means of the present invention provides a relatively simple and yet highly efficient means of opening and closing slide fasteners that are normally inaccessible to the user thereof. The means of the present invention is also relatively inexpensive to produce and does not require any tooling, molding or special manufacturing processes to produce.

The present invention may, of course, be carried out in other specific ways than those herein set forth without departing from the spirit and essential characteristics of such invention. The present embodiments are, therefore, to be considered in all respects as illustrative and not restrictive, and all changes coming within the meaning and equivalency range of the appended claims are intended to be embraced therein.

What is claimed is:

1. A magnetized slide fastener manipulating means comprising; an elongated, relatively light weight handle; a weighted head portion mounted on one end of said handle; a disk shaped magnet mounted on said head portion; and a hook-light means outwardly projecting from the center of said magnet whereby when said magnetized slide fastener manipulating means is being manipulated from an over the shoulder position, the weighted head will have a pendulum effect to aid in connection with the tab of the slide fastener so that the same can be pulled upon in a closing maneuver, and when it is manipulated from behind the waist and is connected to the closed slide fastener, the opening maneuver can be more readily accomplished due to the gravitational pull on the weighted head.

2. The magnetized slide fastener manipulating means of claim 1 wherein said magnet attracts the slide fastener tab to cause the same to stick out for more ready engagement with the hook like means.

3. The magnetized slide fastener manipulating means of claim 1 wherein the weighted head portion is an elbow shaped means.

4. The magnetized slide fastener manipulating means of claim 3 wherein the elbow shaped means is a galvanized steel pipe below.

5. The magnetized slide fastener manipulating means of claim 1 wherein the elongated handle is formed from PVC pipe.

6. The magnetized slide fastener manipulating means of claim 5 wherein said PVC pipe is half inch pipe with an exterior diameter of slightly more than three quarters of an inch.

7. The magnetized slide fastener manipulating means of claim 1 wherein said hook-like means is open facing away from said handle.

* * * * *